United States Patent [19]

Gelon

[11] 3,945,766

[45] Mar. 23, 1976

[54] RADIAL PISTON MACHINE

[75] Inventor: Robert Gelon, Lohr (Main), Germany

[73] Assignee: Rheinische Chamotte - und Dinas Werke, Bonn-Bad Godsperg, Germany

[22] Filed: Oct. 24, 1973

[21] Appl. No.: 409,337

[30] Foreign Application Priority Data

Oct. 28, 1972 Germany ..... 2253022

[52] U.S. Cl. ..... 417/273; 417/319; 417/457; 417/465; 92/118

[51] Int. Cl.[2].. F04B 1/04; F04B 21/00; F01B 15/04

[58] Field of Search ..... 417/273, 464, 465, 319, 417/489, 456, 457, 490, 497; 92/118, 255, 129

[56] References Cited

UNITED STATES PATENTS

| | | | |
|---|---|---|---|
| 1,709,838 | 4/1929 | Carrey | 417/465 |
| 1,910,581 | 5/1933 | Vickers | 417/273 |
| 1,990,703 | 2/1935 | Liddle | 92/119 |
| 2,347,663 | 5/1944 | Carnahan | 417/273 |
| 2,380,607 | 7/1945 | Nystrom | 92/255 |
| 2,502,334 | 3/1950 | Melchior | 417/465 |
| 2,573,472 | 10/1951 | Martin | 417/465 |
| 2,621,607 | 12/1952 | Trapp | 417/273 |
| 2,642,748 | 6/1953 | Widmer | 417/465 |
| 3,227,094 | 1/1966 | Cailloux | 417/464 |
| 3,246,604 | 4/1966 | Brailsford | 417/465 |
| 3,431,865 | 3/1969 | Cook | 417/273 |
| 3,777,622 | 12/1973 | Hause | 417/273 |

FOREIGN PATENTS OR APPLICATIONS

| | | | |
|---|---|---|---|
| 969,120 | 4/1958 | Germany | 417/465 |

*Primary Examiner*—William L. Freeh
*Assistant Examiner*—G. P. LaPointe
*Attorney, Agent, or Firm*—Michael J. Striker

[57] ABSTRACT

A radial piston pump wherein the crank pin of a crankshaft engages with arcuate shoes at inner ends of radially extending pistons which are reciprocable in discrete cylinders. The outer end of each cylinder normally bears against the convex sealing surface of a discrete back support having in the sealing surface a pressure port for evacuation of pressurized fluid in response to outward movement of the respective piston. The cylinders are caused to move their outer ends away from full engagement with the respective sealing surfaces in response to inward movements of the respective pistons so that the chambers of the cylinders can draw fluid from the interior of the pump housing. The cylinders are caused to move substantially radially and away from the respective sealing surfaces due to frictional engagement between their internal surfaces and the external surfaces of the respective pistons. Alternatively, the cylinders are coupled to the respective back supports by discrete springs and are tiltable relative to the back supports by stationary but adjustable abutments provided therefor in the housing; such tilting takes place in automatic response to movement of the respective pistons toward the axis of the crankshaft.

19 Claims, 4 Drawing Figures

RADIAL PISTON MACHINE

BACKGROUND OF THE INVENTION

The present invention relates to radial piston machines in general and more particularly to improvements in radial piston machines wherein the pistons reciprocate in discrete cylinders each of which abuts against a stationary sealing surface, especially a convex or spherical surface. Such types of radial piston machines are often employed as slowly running hydraulic motors with a high torque transmission. As a rule, the heads or shoes of the pistons directly engage the device which causes the pistons to reciprocate in the respective cylinders; therefore, the pressure upon the pistons must be reduced as much as possible in order to avoid a reduction in efficiency due to frictional losses and/or due to wear upon the shoes and/or the reciprocating device. When a machine of the just outlined character is used as a radial piston motor and the means for reciprocating the pistons comprises a crankshaft having an eccentric portion in the form of a crank pin, the flow of hydraulic fluid into the cylinder chambers is regulated by a rotary spool valve which is coupled to the crankshaft. Such mode of regulating the inflow of fluid is not satisfactory when the machine is used as a pump because the quantity of fluid which enters the cylinder chambers by suction is practically nil. Therefore, all radial piston machines of the above outlined character which are used as pumps employ valves wherein the valve members are biased against seats, and such valves are immediately or closely adjacent to the outer ends of cylinders. The just described mounting of the valves contributes to a reduction of dead space.

SUMMARY OF THE INVENTION

An object of the invention is to provide a radial piston machine, especially a radial piston pump, wherein the inflow of fluid into the cylinder chambers is regulated in a novel and improved way.

Another object of the invention is to provide a relatively simple, compact, rugged and reliable radial piston machine which can dispense with discrete valve means for admission of fluid into cylinder chambers.

A further object of the invention is to provide an improved self-priming radial piston pump.

An additional object of the invention is to provide a self-priming radial piston pump wherein the cylinder chambers receive fluid exclusively by suction.

Still another object of the invention is to provide novel and improved motion transmitting connections between the pistons of a radial piston machine and the means which causes the pistons to reciprocate in their cylinders.

The invention is embodied in a radial piston machine, especially in a radial piston pump, which comprises a rotor having an eccentric portion (such rotor may constitute a crankshaft having a crank pin which constitutes the eccentric portion), a plurality of pistons which extend radially of the rotor and have inner end portions in the form of shoes or the like cooperating with the eccentric portion so that the pistons move radially when the rotor rotates, discrete cylinders for the pistons, each cylinder having a chamber and an open end remote from the rotor, a stationary back support for the cylinders, sealing surfaces provided on the back support and normally engaging the outer ends of the cylinders, and a housing defining a fluid-containing compartment which receives the cylinders and the back support. Each cylinder is caused, by mechanical means, to move at least a portion of its open end away from engagement with the respective sealing surface and to thereby allow fluid to flow from the compartment into the respective chamber in response to movement of the respective piston toward the axis of the rotor. The mechanical means may constitute adjustable abutments which are mounted in the housing and tilt the cylinders relative to the respective sealing surfaces, or such mechanical means may constitute the internal surfaces of the cylinders and the external surfaces of the pistons or the external surfaces of piston rings which frictionally engage the respective internal surfaces.

The novel features which are considered as characteristic of the invention are set forth in particular in the appended claims. The improved radial piston machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
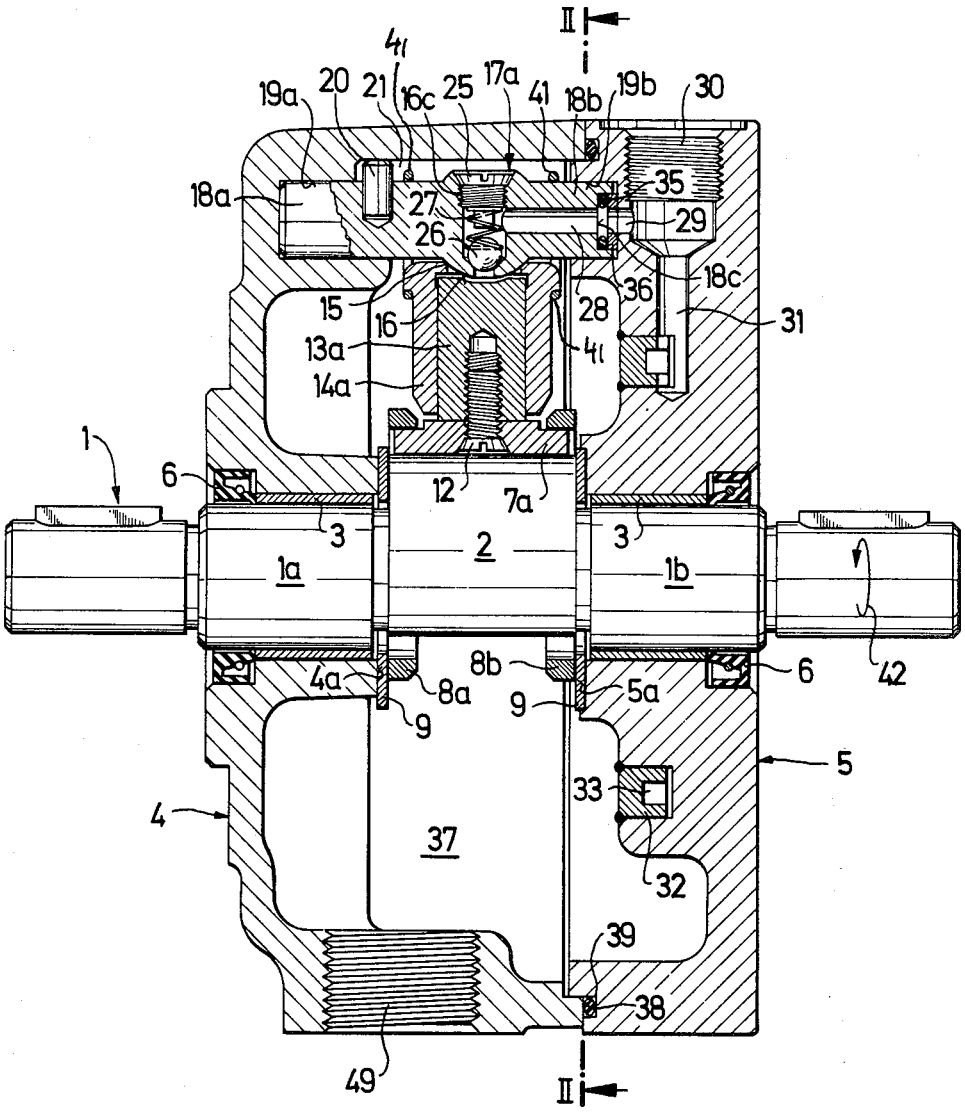
FIG. 1 is an axial sectional view of a radial piston machine which embodies one form of the invention.
Figure 2:
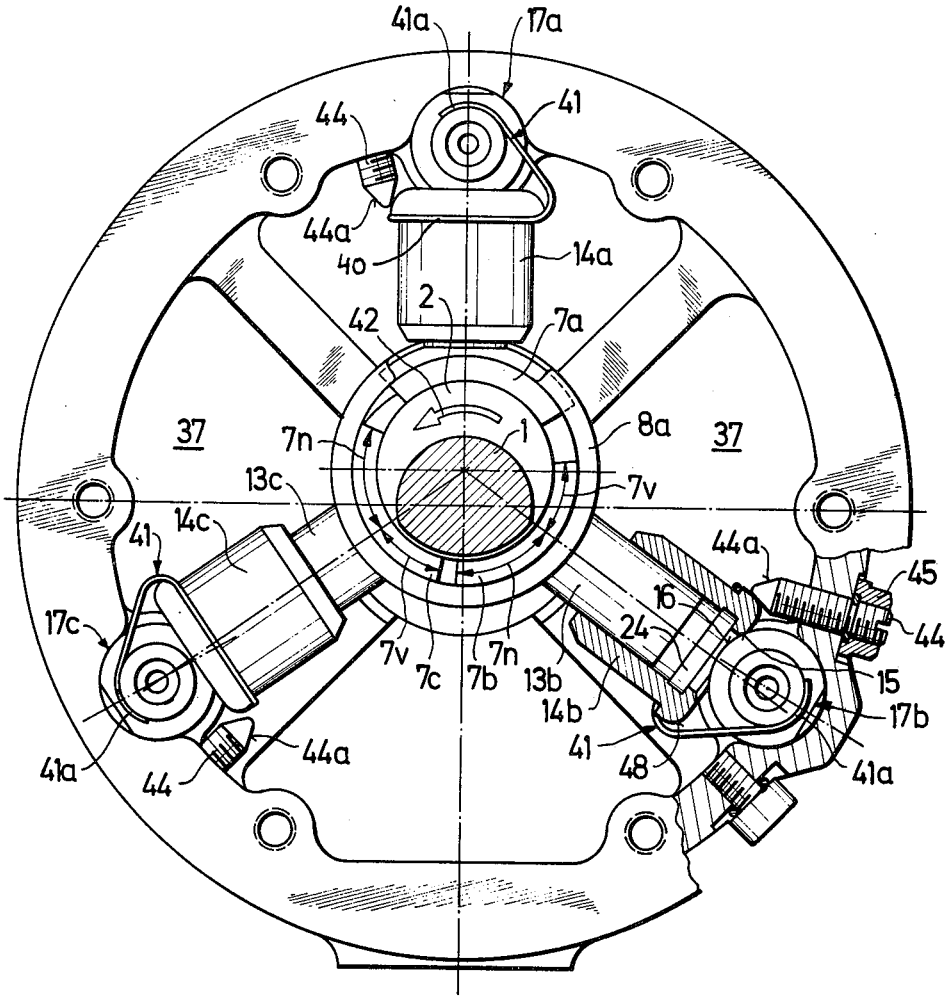
FIG. 2 is a sectional view as seen in the direction of arrows from the line II—II of FIG. 1.
Figure 3:
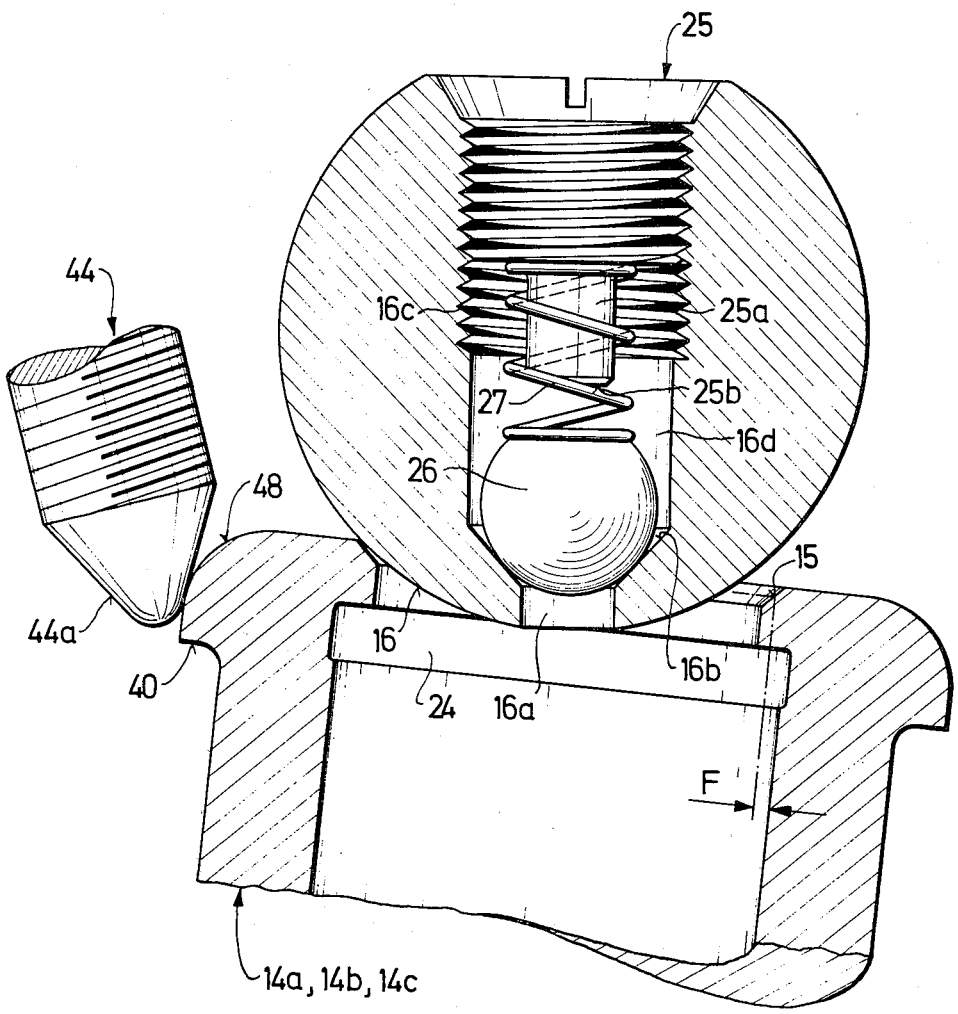
FIG. 3 is an enlarged view of a detail in FIG. 1.

Referring first to FIGS. 1 to 3, there is shown a radial piston machine which is preferably used as a pump and comprises a rotor here shown as a crankshaft 1 having an eccentric portion or crankpin 2 and two end portions 1*a*, 1*b*. The end portions 1*a* and 1*b* are rotatable in friction bearings 3 which are installed in a housing having a cupped main portion 4 and a detachable cover 5. The outer ends of the friction bearings 3 are adjacent to sealing rings 6 which are mounted in suitable recesses provided therefor in the main housing portion 4 and cover 5. The prime mover (e.g., an electric motor) whic drives the crankshaft 1 is not shown in the drawing.

The eccentric portion 2 of the crankshaft 1 is surrounded by three arcuate motion receiving shoes 7*a*, 7*b*, 7*c* which are held against radial and axial movement relative to the crank pin 2 by two ring-shaped retainers 8*a*, 8*b*. These retainers are disposed between two rings 9 one of which abuts against an internal surface 4*a* of the main housing portion 4 and the other of which abuts against an internal surface 5*a* of the cover 5.

The shoes 7*a*–7*c* respectively form part of and are coupled to outer portions of pistons 13*a*, 13*b*, 13*c* which are reciprocable in cylinders 14*a*, 14*b*, 14*c*. The means for rigidly coupling the shoes 7*a*–7*c* to the outer portions of the respective pistons 13*a*–13*c* comprises bolts 12 which can stand certain shearing and/or other stresses and are destroyed (breakable) when such stresses are exceeded so as to avoid greater damage to the machine. Such stresses arise mainly as a result of friction between the pistons 13*a*–13*a* and the respective cylinders 14a–14c and/or as a result of friction between the shoes 7a–7c and the eccentric portion 2 of the crankshaft 1. The eccentric portion 2 is assumed to orbit about the axis of the crankshaft 1 in a counterclockwise direction, as viewed in FIG. 2 (see the arrow 42). Each of the shoes 7a–7c has a relatively long trailing portion 7n and a relatively short leading portion 7v, as considered in the direction of arrow 42 and with respect to the axis of the respective piston 13a, 13b or 13 c. Such non-symmetric mounting of shoes 7a–7c reduces the magnitude of compressive stresses which arise when the machine is in use.

Each of the cylinders 14a–14c is a tubular shell the inner end of which sealingly surrounds the respective piston 13a–13c and the outer end 15 of 13 is provided with a conical sealing surface normally engaging a convex (substantially spherical) sealing surface 16 of one of three fixedly mounted back supports 17a, 17b, 17c. Each of the back supports 17a–17c has a pair of coaxial cylindrical extensions 18a, 18b whose common axis is parallel to the axis of the crankshaft 1. The extensions 18a–18b of each back support 17a–17c are respectively received in bores or sockets 19a of the main housing portion 4 and in bores or sockets 19b of the cover 5. In order to prevent pivoting of the back supports 17a–17c in the housing 4, 5, the extensions 18a are provided with or connected to radially outwardly extending locating pins 20 which are slidable in guide grooves 21 of the main housing portion 4. The pins 20 allow the back supports 17a–17c to move axially, i.e., in parallelism with the axis of the crankshaft 1.

Each of the back supports 17a–17c is provided with a pressure port 16a which is machined into the respective convex sealing surface 16 and is surrounded in part by a conical surface or seat 16b in the respective back support. Each port 16a further includes larger-diameter portion 16d and its outer end is sealed by an externally threaded plug 25 received in a tapped bore 16c of the respective back support. The ports 16a communicate with the cylinder chambers 24 of the respective cylinders 14a–14c and permit pressurized hydraulic fluid to flow from the cylinder chambers 24 in response to opening of one-way check valves including spherical valve members 26 received in the enlarged portions 16d of the respective ports 16a and being biased against the adjacent seats 16b by relatively weak helical valve springs 27. Each valve spring 27 reacts against the respective threaded plug 25 and bears against the adjacent valve member 26. The plugs 25 have smaller-diameter cylindrical extensions 25a which serve to guide the springs 27 and their inner end faces 25b constitute stop faces for the adjacent valve members 26. Thus, the extent to which a valve member 26 can move away from the adjacent seat 16b is determined by the axial position of the respective plug 25. The seats 16b are rather close to the respective convex sealing surfaces 16.

The extensions 18b of the back supports 17a–17c are formed with axially parallel channels or passages 28 which communicate with the enlarged portions 16d of the respective pressure ports 16a and with registering channels or passages 29 of the cover 5. Each channel 29 is in communication with a discharge opening 30 and with a radially inwardly extending blind bore 31 of the cover 5. The discharge openings 30 admit pressurized fluid to consumers, not shown. If the radial piston machine is to supply pressurized fluid to fewer than three consumers, the corresponding discharge opening or openings 30 are sealed by suitable plugs, not shown. The cover 5 may be provided with internal threads surrounding the discharge openings 30 so that the just discussed plugs can threadedly engage the cover 5 to thereby seal the selected discharge opening or openings 30.

The inner side of the cover 5 is formed with a groove for a profiled metallic ring 32 having a U-shaped cross-sectional outline and being preferably welded to the cover 5. A channel or passage 33 which is defined by the ring 32 communicates with the three blind bores 31 to thus insure that all three pressure ports 16a are in communication with each other. Thus, the pressure of fluid in each of the three discharge openings 30 is the same.

The outer end of each extension 18b is formed with a recess 18c for a ring-shaped sealing element 35 which is adjacent to and bears against a washer 36. The latter determines the extent to which the back supports 17a–17c are movable in parallelism with the axis of the crankshaft 1.

The portions 4 and of the housing of the radial piston machine define an annular fluid-containing compartment 37 which communicates with a source of hydraulic fluid (not shown) by way of an inlet opening 49 in the cylindrical part of the main housing portion 4. The rim of the main housing portion 4 is formed with a ring-shaped projection which bears against a ring-shaped sealing element 38 received in a complementary groove 39 of the cover 5. The element 38 prevents leakage of fluid from the compartment 37.

Each of the cylinders 14a, 14b, 14c has a ring-shaped external surface 40 which is adjacent to the respective outer end 15 and is engaged by the inner legs of two springs 41. The outer leg 41a of one spring 41 is partially convoluted around the extension 18a and the outer leg of the other spring 41 is partially convoluted around the extension 18b of the respective back support 17a, 17b or 17c. The springs 41 constitute a means for movably coupling the cylinders 14a–14c to the respective back supports 17a, 17b, 17c. Normally, the springs 41 cause the concave surfaces at the outer ends 15 of the cylinders 14a–14c to abut against the adjacent convex sealing surfaces 16.

The main housing portion 4 further carries three adjustably mounted abutments 44 in the form of externally threaded pins having conical tips 44a serving as fulcra for the respective cylinders 14a, 14b, 14c. As shown in FIG. 2, each abutment 44 mates with the main housing portion 4 and with a lock nut 45 which is applied after the person in charge determines the optimum (selected) axial position of the respective member 44. The abutments 44 are located ahead of the respective cylinders 14a, 14b, 14c, as considered in the direction of arrow 42. The axial position of each abutment 44 is selected in such a way that the conical tips 44a abut against the respective convex external surfaces 48 of the adjacent cylinders 14a–14c when the respective pistons 13a–13c assume their innermost or outermost positions, as considered in the radial direction of the crankshaft 1. The convex surfaces 48 are disposed between the conical surfaces 15 and the respective external surfaces 40.

if the crankshaft 1 is rotated counterclockwise, as viewed in FIG. 2, the piston 13a in the cylinder 14a moves radially inwardly of the respective cylinder 14a and the cylinder 14a is simultaneously caused to pivot about the tip 44a of the respective abutment 44 so that at least one of the springs 41 stores energy and allows the sealing surface 15 at the outer end of the cylinder 14*a* to move away from the adjacent convex sealing surface 16. This allows the fluid which fills the compartment 37 of the housing to flow into the respective cylinder chamber 24 due to the fact that the respective piston 13*a* moves radially inwardly and thus draws fluid into the respective cylinder. The end face 15 of the cylinder 14*a* returns into abutment with the convex surface 16 not later than when the piston 13*a* begins to move radially outwardly whereby the chamber 24 is sealed from the compartment 37 and the valve member 26 moves off its seat 16*b* so as to allow pressurized fluid to leave the chamber 24 by way of the respective port 16*a*. Such fluid flows in the respective passages 28, 29 and into the open discharge openings 30 to reach the consumer or consumers. In FIG. 2, the piston 13*a* in the cylinder 14*a* moves downwardly while the eccentric portion 2 rotates through a first angle of 180° and upwardly while the portion 2 rotates through a second angle of 180° and back to the position shown in FIG. 2. As mentioned above, the springs 27 are preferably weak so that pressurized fluid in the chambers 24 can readily open the one-way valves including the valve members 26 as soon as the pistons 13*a*–13*c* begin to move radially toward the axis of the crankshaft 1. The magnitude of the force which urges the open outer ends 15 of the cylinders 14*a*–14*c* against the respective convex sealing surfaces 16 depends on the fluid pressure in the respective chambers 24 multiplied by the area of the surface F against which pressurized fluid in a cylinder bears to urge the outer end 15 against the adjacent convex sealing surface 16. The surface F equals the difference between the cross-sectional area of a cylinder chamber 24 minus the area of a surface having a diameter corresponding to the median diameter of the sealing surface at the outer end 15 of a cylinder.

It will be noted that each cylinder constitutes with the respective back support a simple but effective valve which enables hydraulic fluid to flow from the compartment 37 into the respective cylinder chamber 24 whenever the corresponding piston moves toward the axis of the crankshaft 1. Thus, the radial piston machine dispenses with discrete valves which are used in conventional machines to regulate the flow of fluid into the cylinder chambers. Another important advantage of the improved machine is that hydraulic fluid which flows into the chambers 24 when the outer ends 15 of the respective cylinders are at least partially disengaged from the adjacent sealing surfaces 16 need not overcome the resistance of springs which are normally employed in conventional inflow-regulating valves. A further advantage is that the movement of cylinders 14*a*–14*c* relative to the respective back supports 17*a*–17*c* provides relatively large paths for the inflow of fluid into the cylinder chambers 24. The length of such paths is extremely small so that losses due to friction between the fluid and the adjacent surfaces during inflow of fluid into the chambers 24 are negligible.

The back supports 17*a*–17*c* can be said to constitute three discrete sections of a composite back support in the housing including the parts 4 and 5.

Figure 4:
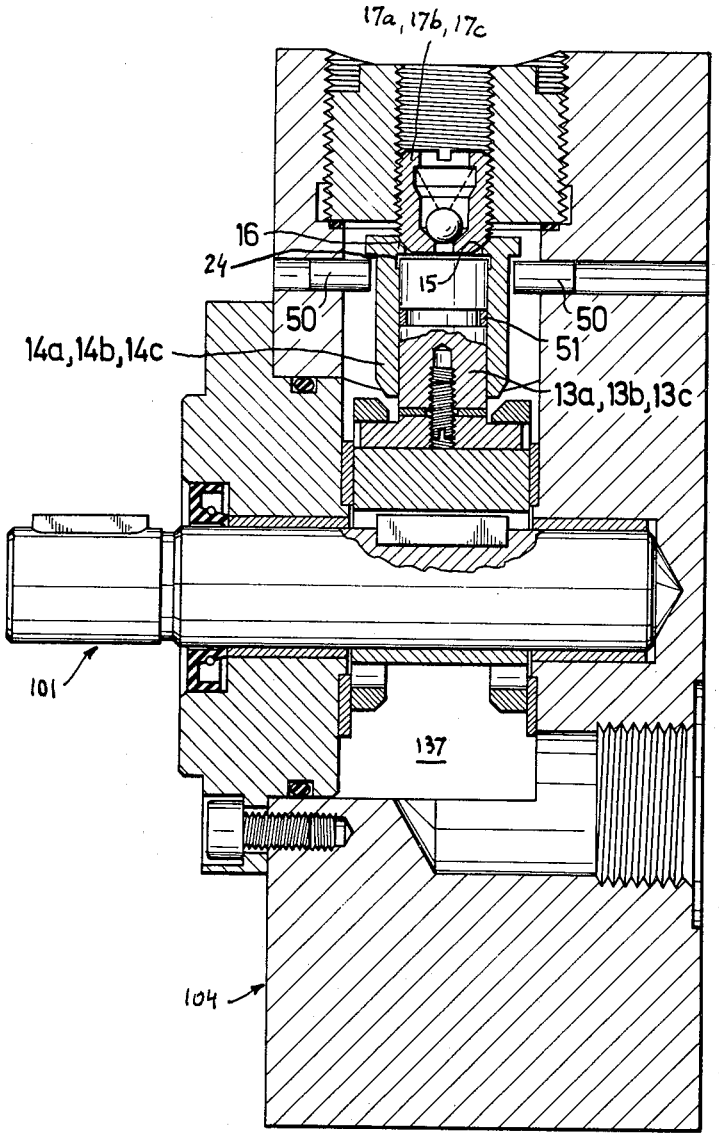
FIG. 4 is an axial sectional view of a modified radial piston machine.

FIG. 4 illustrates a modified radial piston machine wherein the springs 41 and abutments 44 are replaced by parts of pins 50 which are parallel to the crankshaft 101. The cylinders 14*a*–14*c* are caused to move their outer ends 15 away from the convex surfaces 16 of the respective back supports 17*a*–17*c* due to friction between their internal surfaces and the external surfaces of associated pistons 13*a*–13*c*. Such friction is preferably increased by piston rings 51 which are recessed into circumferential grooves of the pistons 13*a*–13*c* and bear against the internal surfaces of the corresponding cylinders.

Friction between the cylinders 14*a*–14*c* and pistons 13*a*–13*c* also causes the cylinders to return their outer ends 15 into engagement with the respective sealing surfaces 16 when the corresponding pistons move radially outwardly. The manner in which fluid can flow from the compartment 137 of the housing 104 into cylinder chambers 24 and from the chambers 24 into the discharge openings (not shown in FIG. 4) is the same as described in connection with FIGS. 1–3.

The improved radial piston machine is susceptible of many additional modifications without departing from the spirit of the invention. For example, the number of cylinders and pistons can be reduced to one or two or increased to more than three. Also, the construction of check valves in the back supports 17*a*–17*c* can deviate from that shown in FIG. 3. All that counts is to provide the machine with mechanical means (such as the abutments 44 or the friction generating piston rings 51) for insuring that the outer ends 15 of the cylinders 14*a*–14*c* are disengaged from the associated convex sealing surfaces 16 while the pistons 13*a*–13*c* perform suction strokes to thus allow the fluid to flow from the compartment 37 or 137 into the chambers 24 whenever the volume of such chambers increases due to movement of the pistons toward their inner end positions.

Without further analysis, the foregoing will so fully reveal the gist of the present invention that others can, by applying current knowledge, readily adapt it for various applications without omitting features which fairly constitute essential characteristics of the generic and specific aspects of my contribution to the art, and therefore, such adaptations should and are intended to be comprehended within the meaning and range of equivalence of the claims.

What is claimed as new and desired to be protected by Letters Patent is set forth in the appended claims:

1. In a radial piston machine, especially in a radial piston pump, a combination comprising a rotor having an eccentric portion; a plurality of pistons extending radially of said rotor and having inner end portions cooperating with said eccentric portion so that said pistons move radially back and forth when said rotor rotates; discrete cylinders for said pistons, each of said cylinders having a chamber and an open end remote from said rotor and communicating with the respective chamber; a stationary back support for said cylinders, said back support having sealing surfaces each normally engaging only the open end of one of said cylinders; and a housing defining a fluid-containing compartment receiving said cylinders and said back support, each of said cylinders being arranged to radially retract at least a portion of its open end out of engagement with the respective sealing surface and to thereby allow fluid to flow between said compartment and the respective chamber in response to movement of the corresponding piston toward the axis of said rotor.

2. A combination as defined in claim 1, wherein said rotor is a crankshaft having a crank pin which constitutes said eccentric portion thereof, each of said sealing surfaces forming part of a spherical surface.

3. A combination as defined in claim 1, wherein said pistons have external surfaces in frictional engagement with the internal surfaces of the respective cylinders and such frictional engagement entails the movement of said portions of said open ends from the respective sealing surfaces in response to radially inward movement of said pistons.

4. A combination as defined in claim 3, further comprising friction-generating elements interposed between said pistons and the respective cylinders.

5. A combination as defined in claim 4, wherein said pistons have circumferential grooves and said friction-generating elements are piston rings received in the respective grooves and engaging the internal surfaces of the respective cylinders.

6. In a radial piston machine, especially in a radial piston pump, a combination comprising a rotor having an eccentric portion; a plurality of pistons extending radially of said rotor and having inner end portions cooperating with said eccentric portion so that said piston move radially back and forth when said rotor rotates; discrete cylinders for said pistons each of said cylinders having a chamber and an open end remote from said rotor and communicating with the respective chamber; a stationary back support for said cylinders, said back support having sealing surfaces each normally engaging only the open end of one said cylinders; a housing defining a fluid-containing compartment receiving said cylinders and said back support, each of said cylinders being arranged to move at least a portion of its open end out of engagement with the respective sealing surface and to thereby allow fluid to flow between said compartment and the respective chamber in response to movement of the corresponding piston toward the axis of said rotor; and means for yieldably biasing said open ends of said cylinders against the respective sealing surfaces.

7. A combination as defined in claim 6, wherein said biasing means comprises discrete springs for said cylinders, each of said springs having a first portion engaging the respective cylinder and a second portion engaging said back support.

8. A combination as defined in claim 7, wherein said sealing surfaces constitute portions of spherical surfaces and further comprising means for pivoting said cylinders with respect to said back support in response to radially inward movements of said pistons, said means for pivoting comprising abutments provided in said housing and providing fulcra for the outer ends of said cylinders during movement of the respective pistons toward the axis of said rotor.

9. A combination as defined in claim 8, wherein said rotor is arranged to rotate in a predetermined direction and said abutments are located ahead of the respective cylinders, as considered in said predetermined direction.

10. A combination as defined in claim 9, wherein said cylinders have external surfaces abutting against said fulcra during movement of the respective pistons from the outer to the inner end positions thereof relative to the respective cylinders.

11. A combination as defined in claim 8, wherein at least one of said abutments is movable relative to said housing and further comprising means for holding said one abutment in a selected position.

12. A combination as defined in claim 1, wherein said back support comprises a discrete section for each of said cylinders and means for securing said sections to said housing.

13. In a radial piston machine, especially in a radial piston pump, a combination comprising a rotor having an eccentric portion; a plurality of pistons extending radially of said rotor and having inner end portions cooperating with said eccentric portion so that said pistons move radially back and forth when said rotor rotates; discrete cylinders for said pistons, each of said cylinders having a chamber and an open end remote from said rotor and communicating with the respective chamber; a stationary back support comprising a discrete section for each of said cylinders, each of said sections having a sealing surface normally engaging the open end of a respective cylinder; a housing defining a fluid-containing compartment receiving said cylinders and said back support, each of said cylinders being arranged to move at least a portion of its open end out of engagement with the respective sealing surface and to thereby allow fluid to flow between said compartment and the respective chamber in response to movement of the corresponding piston toward the axis of said rotor; and at least one substantially cylindrical extension parallel to said rotor and each of said sections and received in a complementary socket in said housing for securing said sections to said housing.

14. A combination as defined in claim 13, wherein each of said sections has only a single port, said port communicating with the respective cylinder chamber and with a discharge opening of said housing, a one-way valve for normally sealing said discharge opening from the respective chamber, and a passage provided in said extension and connecting said discharge opening with the respective port.

15. A combination as defined in claim 14, wherein each of said one-way valves is installed in the respective port immediately adjacent to the respective sealing surface.

16. In a radial piston machine, especially in a radial piston pump, a combination comprising a rotor having an eccentric portion; a plurality of pistons extending radially of said rotor, each of said pistons having an inner end portion; an arcuate shoe at the inner end portion of each piston slidably engaging said eccentric portion of said rotor; a coupling connecting each arcuate shoe with the respective piston end portions so that said pistons move radially back and forth when said rotor rotates, said coupling being arranged to break and to thus terminate the connection between said shoe and said inner end portion in response to the application of a predetermined stress; discrete cylinders for said pistons, each of said cylinders having a chamber and an open end remote from said rotor and communicating with the respective chamber; a stationary back support for said cylinders, said back support having sealing surfaces each normally engaging only the open end of one of said cylinders; and a housing defining a fluid-containing compartment receiving said cylinders and said back support, each of said cylinders being arranged to move at least a portion of its open end out of engagement with the respective sealing surface and to thereby allow fluid to flow between said compartment and the respective chamber in response to movement of the corresponding piston toward the axis of said rotor.

17. A combination as defined in claim 16, wherein said coupling is a threaded bolt.

18. A combination as defined in claim 1, wherein said rotor comprises a crankshaft having a crank pin which constitutes said eccentric portion and said inner end portions of said pistons constitute arcuate shoes each slidably engaging with said crank pin, each of said shoes comprising a relatively short leading portion and a relatively long trailing portion, as considered in the direction of rotation of said crankshaft.

19. A combination as defined in claim 18, wherein said leading and trailing portions are located at the opposite sides of the axes of the respective pistons.

* * * * *

UNITED STATES PATENT AND TRADEMARK OFFICE

CERTIFICATE OF CORRECTION

PATENT NO. : 3,945,766

DATED : March 23, 1976

INVENTOR(S) : Robert Gelin

It is certified that error appears in the above-identified patent and that said Letters Patent are hereby corrected as shown below:

Above the heading, directly beneath "United States Patent [19]", the name of the inventor should read "Gelin".

In the heading [75], the name of the inventor should read "Gelin".

In the heading [73], the name and address of the assignee should read "G. L. Rexroth GmbH, Lohr/Main, Germany".

Signed and Sealed this

Tenth Day of August 1976

[SEAL]

*Attest:*

RUTH C. MASON
*Attesting Officer*

C. MARSHALL DANN
*Commissioner of Patents and Trademarks*